US006274180B1

(12) United States Patent
Ryan et al.

(10) Patent No.: US 6,274,180 B1
(45) Date of Patent: Aug. 14, 2001

(54) EXPANDABLE BEVERAGE INFUSION DEVICE

(75) Inventors: David Ryan; Matt S. Vaughan, both of Seattle, WA (US)

(73) Assignee: JSD Partners, Waterbury, CT (US)

( * ) Notice: Subject to any disclaimer, the term of this patent is extended or adjusted under 35 U.S.C. 154(b) by 0 days.

(21) Appl. No.: 09/312,463

(22) Filed: May 17, 1999

(51) Int. Cl.[7] ..... B65B 29/02

(52) U.S. Cl. ..... 426/82; 426/77; 426/110; 426/394; 426/433; 426/435

(58) Field of Search ..... 426/82, 83, 77, 426/110, 433, 435, 394; 383/25, 120; 210/493.1, 493.3, 493.5, 237

(56) References Cited

U.S. PATENT DOCUMENTS

| | | | | |
|---|---|---|---|---|
| D. 317,972 | | 7/1991 | Liu et al. . | |
| 1,489,806 | | 4/1924 | Anderson . | |
| 2,308,241 | | 1/1943 | Hogaboom, Jr. . | |
| 2,606,836 | | 8/1952 | McCabe . | |
| 2,728,672 | | 12/1955 | Young et al. . | |
| 2,800,408 | | 7/1957 | Fimple . | |
| 2,867,536 | | 1/1959 | Mead et al. . | |
| 2,986,269 | | 5/1961 | Goldberg . | |
| 3,047,397 | | 7/1962 | Irmscher . | |
| 3,057,729 | | 10/1962 | Grant . | |
| 3,092,242 | | 6/1963 | Irmscher . | |
| 3,102,465 | | 9/1963 | Montesano . | |
| 3,193,388 | | 7/1965 | Conrey . | |
| 3,387,978 | | 6/1968 | Major . | |
| 3,550,528 | | 12/1970 | O'Neill . | |
| 3,615,595 | | 10/1971 | Rambold . | |
| 4,098,177 | * | 7/1978 | Olney et al. | 99/310 |
| 4,211,156 | | 7/1980 | Zimmerman . | |
| 4,215,628 | | 8/1980 | Dodd, Jr. . | |
| 4,278,691 | * | 7/1981 | Donarumma et al. | 426/80 |
| 4,337,561 | * | 7/1982 | Janus | 29/157 R |
| 4,410,550 | | 10/1983 | Gaskill . | |
| 4,465,697 | | 8/1984 | Brice et al. . | |
| 4,552,657 | * | 11/1985 | Ojana | 210/169 |
| 4,609,556 | * | 9/1986 | Goedirt | 426/394 |
| 4,651,870 | | 3/1987 | Giambalvo . | |
| 4,699,794 | | 10/1987 | Brice et al. . | |
| 4,717,016 | | 1/1988 | Dalgleish . | |
| 4,726,956 | | 2/1988 | (no name) . | |
| 4,735,810 | | 4/1988 | Dacal . | |
| 4,806,369 | | 2/1989 | Thompson . | |
| 4,826,695 | | 5/1989 | Tanner . | |
| 4,828,850 | * | 5/1989 | Davis | 426/77 |
| 4,860,929 | | 8/1989 | Lowe et al. . | |
| 4,871,555 | * | 10/1989 | Schwartz et al. | 426/82 |

(List continued on next page.)

*Primary Examiner*—Milton Cano
*Assistant Examiner*—Hao Mai
(74) *Attorney, Agent, or Firm*—DeLio & Peterson, LLC

(57) ABSTRACT

A beverage infusion device comprises a handle and a support member extending from the handle having a pair of flat legs spaced apart by a predetermined width. Attached to each side of the flat legs is a flexible porous member, for example, a pouch of filter material having an unfolded width greater than the width of the support legs. Each porous member contains an infusible beverage preparation and is supported by the support legs in a folded position wherein, upon immersion of the porous members in a liquid, the porous members expand and become spaced to facilitate infusion of a beverage preparation therein into the liquid. In the folded position, the porous members may have a plurality of folds across its width, for example, folds adjacent the first and second ends and an unfolded portion therebetween. The first and second ends of the porous member are preferably heat bonded to the support legs. The device handle is of a configuration to fit between the pair of legs such that the handle and the legs may be stamped from a single piece of flat stock of paper- or plastic-based materials.

16 Claims, 6 Drawing Sheets

U.S. PATENT DOCUMENTS

| | | | | |
|---|---|---|---|---|
| 4,981,588 | | 1/1991 | Poulallion . | |
| 4,986,451 | | 1/1991 | Lowe et al. . | |
| 4,987,410 | * | 1/1991 | Dinos | 426/77 |
| 5,047,252 | | 9/1991 | Liu et al. . | |
| 5,076,425 | | 12/1991 | Plone . | |
| 5,091,197 | | 2/1992 | Ferro et al. . | |
| 5,318,786 | * | 6/1994 | Clarkson | 426/79 |
| 5,605,710 | | 2/1997 | Pridonoff et al. . | |
| 5,618,425 | * | 4/1997 | Mitamura et al. | 210/497.5 |
| 5,736,041 | * | 4/1998 | Skov | 210/445 |
| 5,736,042 | * | 4/1998 | Aoki | 210/474 |
| 5,809,868 | | 9/1998 | Milone . | |
| 5,863,575 | * | 1/1999 | Kuipers et al. | 426/80 |
| 5,906,844 | * | 5/1999 | Stahli et al. | 426/77 |

* cited by examiner

EXPANDABLE BEVERAGE INFUSION DEVICE

BACKGROUND OF THE INVENTION

1. Field of the Invention

The present invention relates to a device for producing a beverage from an infusible beverage preparation and, in particular, to a portable beverage infusion device for preparing a single serving beverage and a method of making such device.

2. Description of Related Art

Numerous devices have been disclosed for preparing infusible beverage substances or preparations such as coffee, tea or the like. Among these are those disclosed in U.S. Pat. Nos. 4,410,550, 4,211,156, 4,465,697, 4,699,794, 4,717,016, 4,806,369, 4,826,695, 4,981,588, and 5,605,710, and in defensive publication T973,014.

A particularly useful beverage infusion device is disclosed in U.S. Pat. No. 5,809,868 which is directed to a collapsible infusion device which has a tubular handle into which may be received a tubular body containing the infusible beverage preparation.

While these devices have been useful, and the '868 device in particular is space saving, none of these devices have been particularly easy or inexpensive to manufacture.

Bearing in mind the problems and deficiencies of the prior art, it is therefore an object of the present invention to provide a beverage infusion device which is easy and inexpensive to manufacture.

It is another object of the present invention to provide a beverage infusion device which is particularly suitable for mass production.

Yet another object of the present invention is to provide a beverage infusion device which increases contact area between the liquid, such as hot water, and the infusible beverage preparation, such as coffee, to facilitate greater flow of the liquid through the beverage preparation.

A further object of the invention is to provide a method of manufacturing a beverage device which meets the aforementioned criteria.

Still other objects and advantages of the invention will in part be obvious and will in part be apparent from the specification.

SUMMARY OF THE INVENTION

The above and other objects, which will be appreciated by those skilled in the art, are achieved in the present invention which provides, in one aspect, a beverage infusion device comprising a handle, a support member extending from the handle, and a flexible porous member having first and second ends and an unfolded width between the first and second ends greater than the support member. The porous member is adapted to contain an infusible beverage preparation. The first and second ends of the porous member are supported by the support member with the porous member in a folded position. Upon immersion of the porous member in a liquid, the porous member expands to facilitate infusion of a beverage preparation therein into the liquid.

In another aspect, the present invention provides a beverage infusion device comprising a handle, a support member extending from the handle having a pair of legs spaced apart by a predetermined width, and a flexible porous member having an unfolded width greater than the predetermined width attached to each of the support legs. The porous member is adapted to contain an infusible beverage preparation. The porous member is supported by the support legs in a folded position wherein, upon immersion of the porous member in a liquid, the porous member expands to facilitate infusion of a beverage preparation therein into the liquid.

Either of the aforementioned devices may include a plurality of the flexible porous members supported by the support member or support legs. Preferably, the support member and support legs are flat and have opposite sides, and the support member or support legs support the porous member on each of the opposite sides. In the folded position, the porous member may have a plurality of folds across its width, for example, folds adjacent the first and second ends and an unfolded portion therebetween. The first and second ends of the porous member are preferably heat bonded to the support member or support legs. Most preferably, the porous member comprises a pouch of filter material, with the infusible beverage preparation being adapted to be received within the pouch.

In the case of the device having the support legs, the handle is of a configuration to fit between the pair of legs such that the handle and the legs may be stamped from a single piece of stock. The handle may be integral with the support member and stamped from the same piece of flat stock selected from the group consisting of paper- or plastic-based materials.

In a further aspect, the present invention provides a beverage infusion device comprising a support member having a pair of legs spaced apart by a predetermined width, a flexible porous member attached to each of the support legs, the porous member adapted to contain an infusible beverage preparation and a handle extending from the support member, the handle being of a configuration to fit between the pair of legs such that the handle and the legs may be stamped from a single piece of stock. Preferably, the handle is integral with the support member and stamped from the same piece of flat stock selected from the group consisting of paper- or plastic-based materials.

In yet another aspect, the present invention provides a method of making a beverage infusion device comprising providing flat stock of a material which is foodsafe and stable in hot water and stamping from the flat stock a plurality of beverage infusion device support members. Each of the support members has at one end a pair of legs spaced apart by a predetermined width and at an opposite end a handle. The handle is of a configuration to fit between the pair of legs, such that a handle of one support member is stamped from a region of the flat stock between legs of a preceding or subsequent support member. The method includes attaching to the legs of the support members a flexible porous member, the porous member adapted to contain an infusible beverage preparation.

Preferably, in each of the support members, the handle is integral with the legs and is stamped from the same piece of flat stock selected from the group consisting of paper- or plastic-based materials. The method may further include inserting an infusible beverage preparation into the flexible porous member.

In a further aspect, the present invention provides a method of infusing a beverage into a liquid comprising providing a beverage infusion device having a handle; a support member extending from the handle; and a flexible porous member having first and second ends and an unfolded width between the first and second ends greater than the support member. The porous member contains an infusible beverage preparation, and the first and second ends of the porous member are supported by the support member with the porous member in a folded position. The method includes immersing the porous member in a liquid and expanding the porous member to facilitate infusion of a beverage preparation therein into the liquid. Preferably, the device includes a plurality of flexible porous members supported by the support member, wherein the plurality of flexible porous members become spaced upon immersing in the liquid and expanding.

Brief Description of the Drawings

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
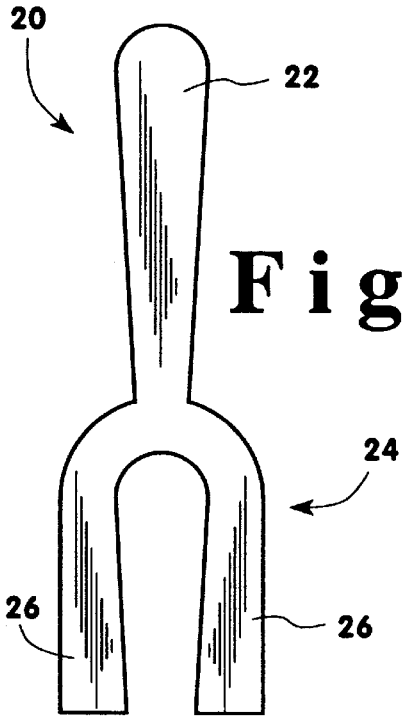
FIG. 1 is a top plan view of the preferred handle and support member for the beverage infusion device of the present invention.

In describing the preferred embodiment of the present invention, reference will be made herein to FIGS. 1–20 of the drawings in which like numerals refer to like features of the invention. Features of the invention are not necessarily shown to scale in the drawings.

Figure 2:
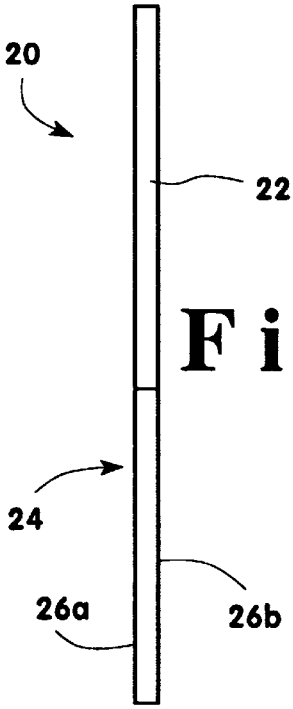
FIG. 2 is a side view of the handle and support member of FIG. 1.

The preferred support member and handle for the beverage infusion device of the present invention is depicted in FIGS. 1 and 2. The support device 20 is preferably made of a paper- and/or plastic-based flat stock which is foodsafe, i.e., non-toxic and approved for use in connection with foods by the FDA. Support device 20 should also be stable in hot water, in which many of the infusible beverage preparations are to be prepared. More preferably, the flat stock material is adapted to be bonded by adhesive and, most preferably, heat bonded to filter paper which is used for the porous material holding the infusible beverage preparation, which will be discussed later in more detail. The flat stock may contain therefore some proportion of heat bondable plastic fibers dispersed within paper pulp to facilitate heat bonding, or be coated and/or laminated with such a material, and may be made from existing, well-known materials or produced as desired without undue experimentation. Alternatively, support device 20 may be formed by other well-known methods and materials, such as molded plastic.

Support device 20 comprises a support member 24 which in the preferred embodiment shown includes a pair of spaced apart legs 26. Extending from support member 24 in a direction opposite to legs 26 is an elongated handle 22 sized to be gripped by the user's fingers. As will also be also explained later, legs 26 are bonded to and support the porous material for the infusible beverage preparation. The use of the flat stock shown makes such bonding and support possible on both opposite sides 26*a* and 26*b* of legs 26 as shown in FIG. 2.

The combined height of the handle and support member 20 is preferably on the order of about 4 inches and the width of the support member is preferably on the order of about 1.2 inches. In order to insure efficient production, handle 22 is preferably configured to fit precisely within the region between legs 26.

Figure 3:
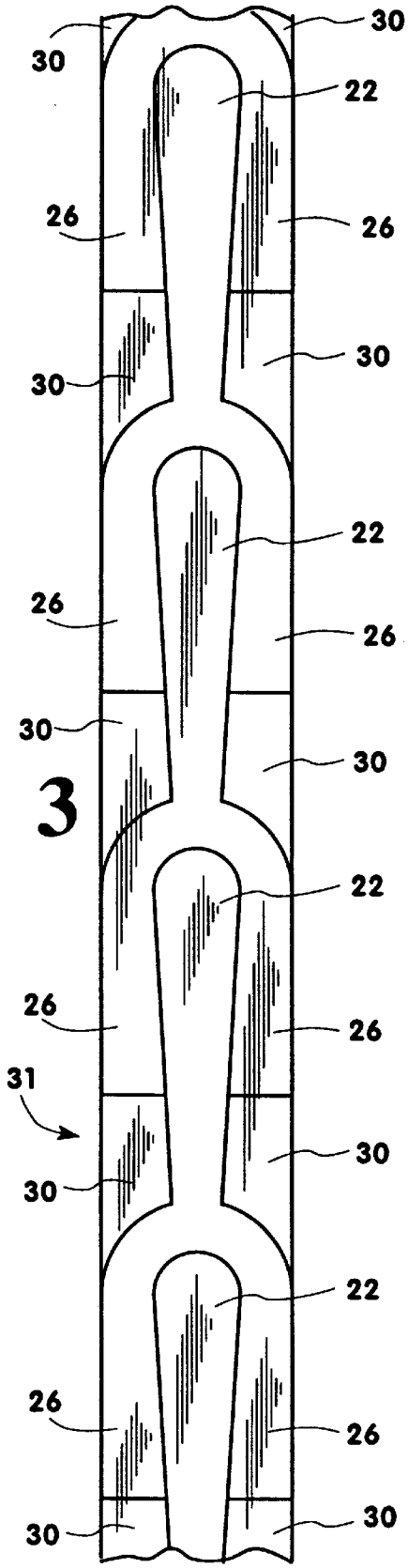
FIG. 3 is a top plan view of a strip of flat stock from which the handle and support member of FIG. 1 may be stamped.

The preferred manufacturing method for support devise 20 is shown in FIG. 3. Handle 22 of one support device extends within the legs 26 of a preceding or succeeding support device such that there is no waste or scrap material across the width of flat stock strip 31 in the region of support member 24 after stamping. The only manufacturing waste or scrap are segments 30 which are stamped out from the sides of the lower portion of handle 22, above and below the leg portions of the support members of adjacent devices. In production, a stamping die configured to the shape of support device 20 repeatedly stamps successive devices 20 from flat stock 31.

Following the manufacture of support device 20, there is attached to the support member portion 24 a porous member which is adapted to receive within it the infusible beverage preparations. Such infusible beverage preparations may include coffee, tea or other substances which when placed in liquid, preferably hot water, infuse the liquid with the beverage.

Figure 4:
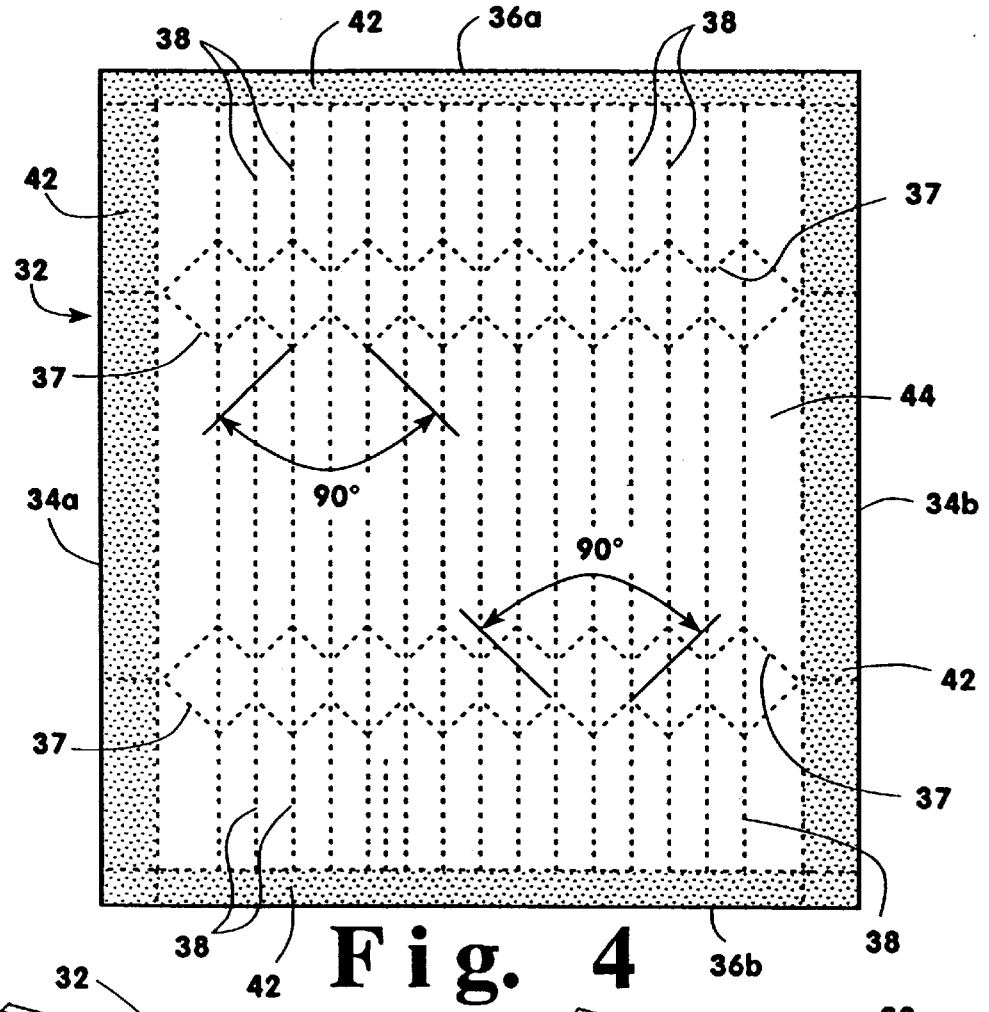
FIG. 4 is a top plan view of a first embodiment of the porous member which receives the infusible beverage preparation.

A first embodiment of the porous member is shown in FIG. 4 in which a porous member 32 is made from a single flat sheet of a conventional thin, flexible, porous filter material 44 of paper or the like. The first embodiment of porous member 32 made from porous material which is adapted to be heat sealed along the shaded areas 42 along the top edge 36*a*, bottom edge 36*b*, left edge 34*a* and right edge 34*b* as indicated. Vertical fold lines 38 are indicated by vertical dotted lines which extend across the entire width of porous member 32 at approximately evenly spaced intervals. Horizontal fold lines 37 are disposed across the top portion approximately one-fourth of the, distance from the top edge 36*a* and along the bottom approximately one-fourth of the distance above bottom edge 36*b*. The horizontal fold lines 37 have alternating zigzag shapes at approximately 90° angles as indicated.

Figure 5:
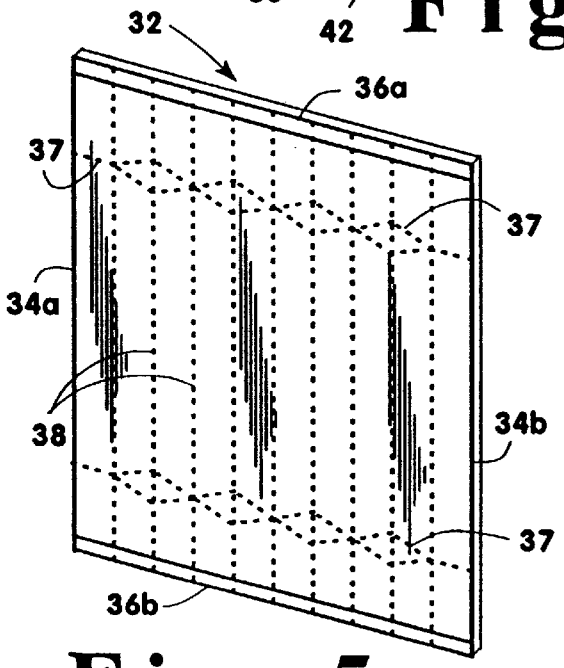
FIGS. 5–10 are perspective views of the sequential steps in assembling the porous member of FIG. 4, filling it with the infusible beverage preparation, and sealing and attaching it to the handle and support member of FIG. 1.

FIGS. 5–10 depict the preferred method of assembly of porous member 32 depicted in FIG. 4. In FIG. 5, the porous material 32 is first opened fully in a flat position. The width of porous member 34, i.e. the distance between side edges 34*a* and 34*b*, is greater than the width of support member 24 as shown in FIG. 1.

Figure 6:
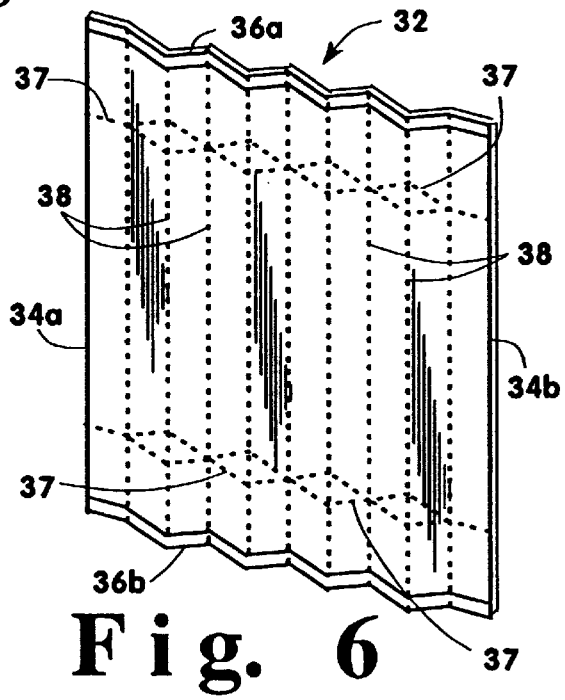
Figure 7:
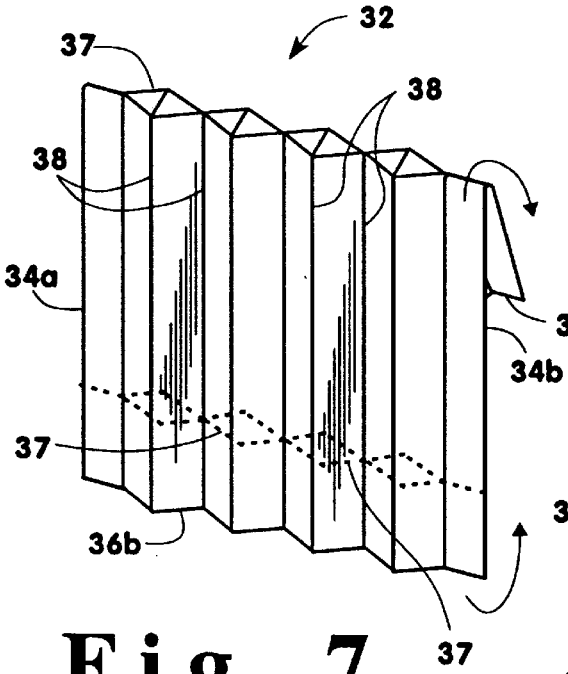

Porous member 32 is folded alternately along vertical fold lines 38 across the entire width of the member, as depicted in FIG. 6. In FIG. 7, the upper and lower portions of porous member 32 are folded down and up, respectively, along horizontal fold lines 37 and overlapping portions of top edge 36*a* and bottom edge 36*b* are bonded together, preferably by heat sealing.

Figure 9:
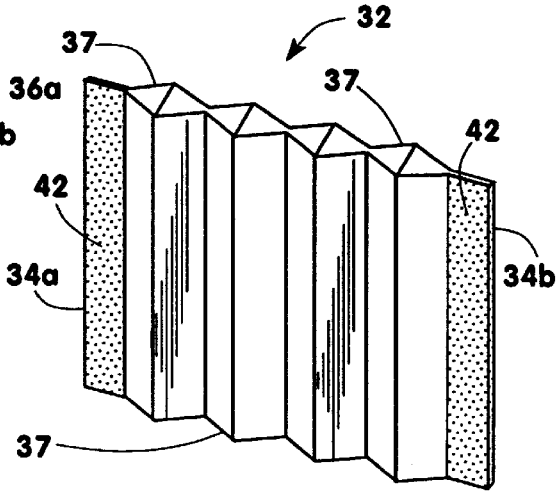
Figure 8:
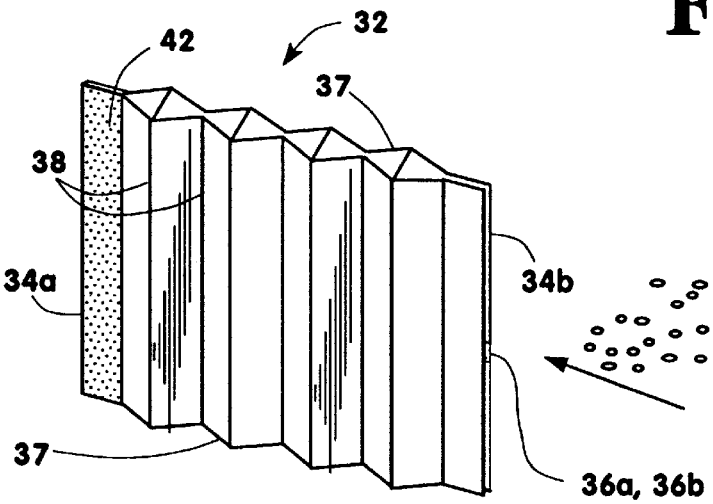
Figure 10:
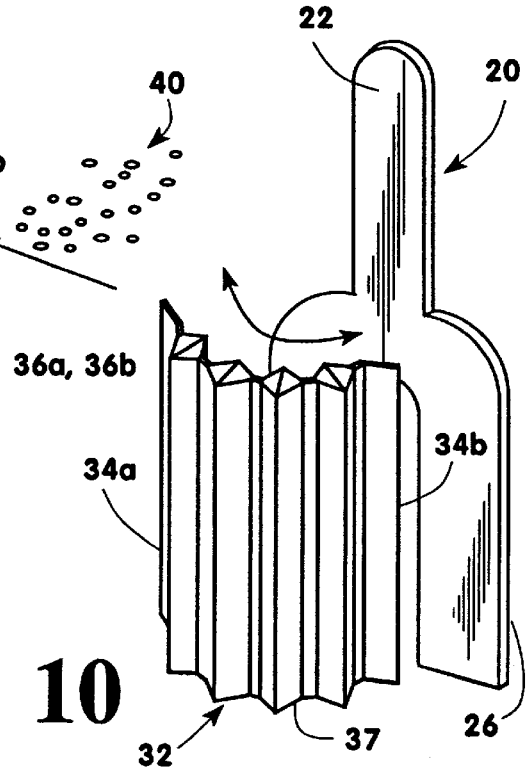

As shown in FIG. 8, right edge 34*a* is bonded along region 42 preferably by heat sealing, to form a pouch with an open end at edge 34*b* into which may be inserted coffee 40 or other infusible beverage preparation. The left edge 34*b* is then heat sealed, as shown in FIG. 9. The entire sealed porous member 32 is then secured to support device 20 as shown in FIG. 10. One edge 34*a* is bonded to one leg 26 of support member 24 while the opposite edge 34*b* is bonded to the other leg 26 of support member 24. A second porous member may be bonded to the opposite sides of legs 26.

Figure 11:
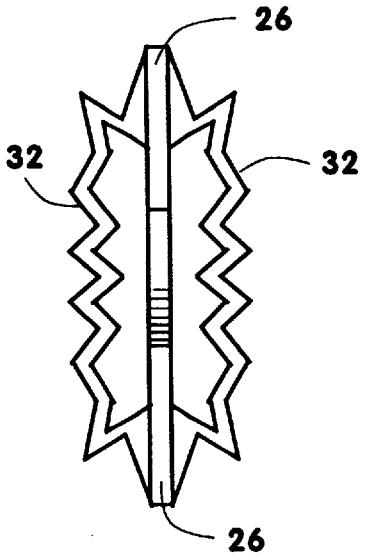
FIG. 11 is a bottom view of the first embodiment of the beverage infusion device of the present invention in a dry, folded position.
Figure 12:
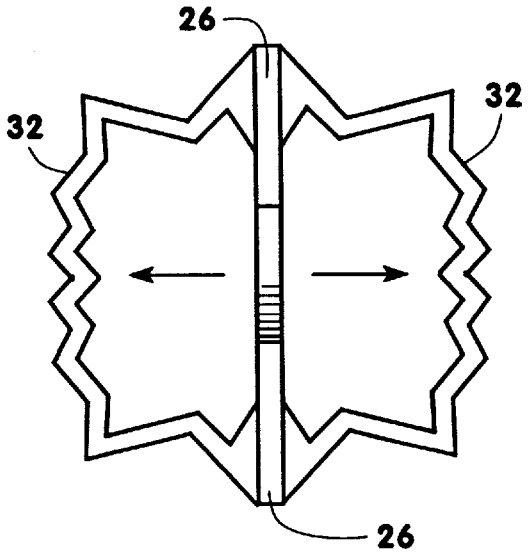
FIG. 12 is a bottom view of the embodiment of FIG. 11 after immersion in a liquid in an expanded, unfolded position.

FIG. 11 depicts the beverage infusion device of the present invention after both porous members 32 are attached to opposite sides of legs 26. In its as-manufactured configuration, each of the porous members 32 is in a folded position with the opposite ends being supported by the support member. The porous member stays generally in the folded position while dry. In use, the handle is grasped and the lower portion of device 20 comprising the support legs 26 and the porous members 32 are inserted into a liquid. After immersion in the liquid (FIG. 12), porous members expand and unfold as the liquid permeates between and through the spaced porous members 32 and reach the infusible beverage preparation inside each. This expansion facilitates the infusion process.

Figure 13:
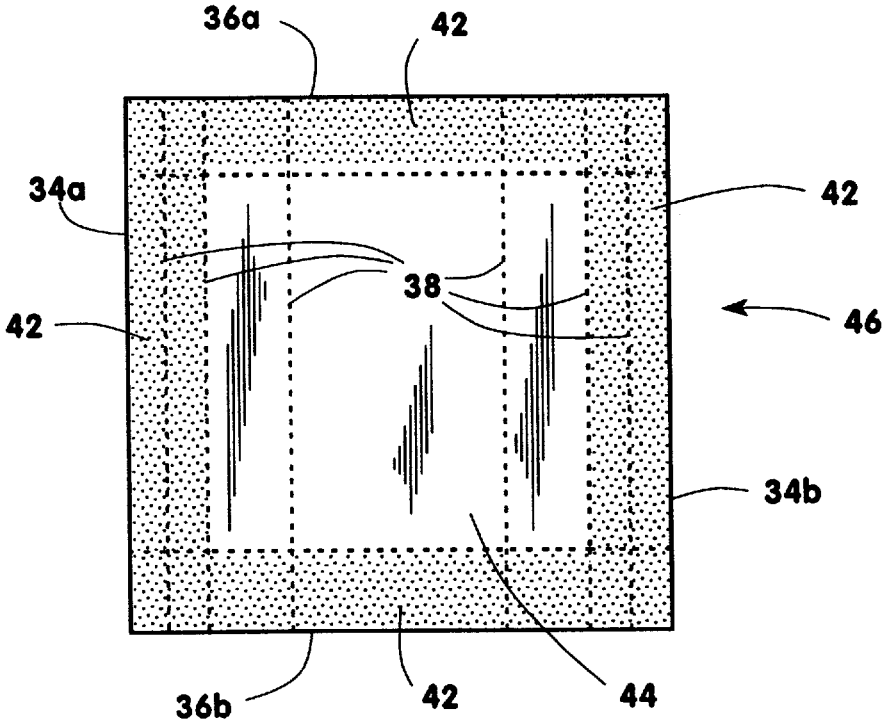
FIG. 13 is a top plan view of a second embodiment of the porous member which receives the infusible beverage preparation.

Another embodiment of a porous member is depicted in FIG. 13. Porous member 46 is made from separate sheets of filter material 44 which is adapted to be heat bonded in regions 42 along upper edge 36*a*, lower edge 36*b*, left edge and right edge 34*b*. As with the embodiment depicted FIG. 4, the width of porous member 46 between edges 34*a* and 34*b* is wider than the width of support member 24 in support device 20 of FIG. 1. Porous member 46 has vertical fold lines 38 which are shown near the opposite side edges of the material, but which do not extend into the central region of the filter material.

Figure 14:
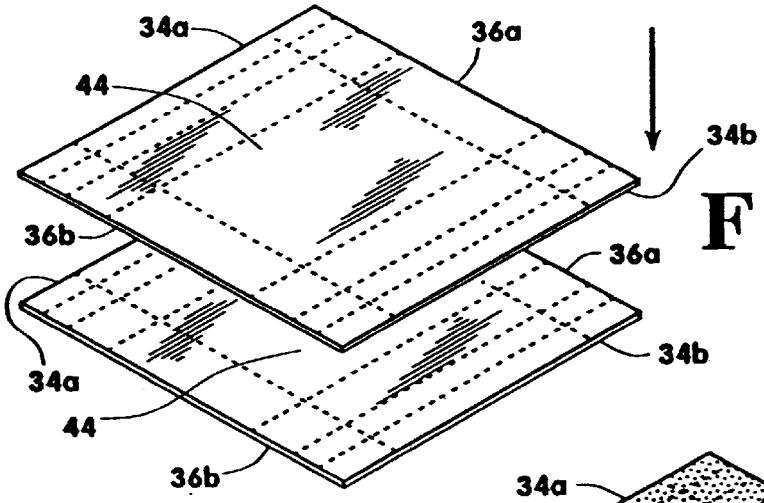
FIGS. 14–20 are perspective views of the sequential steps in assembling the porous member of FIG. 13, filling it with the infusible beverage preparation, and sealing and attaching it to the handle and support member of FIG. 1.
Figure 15:
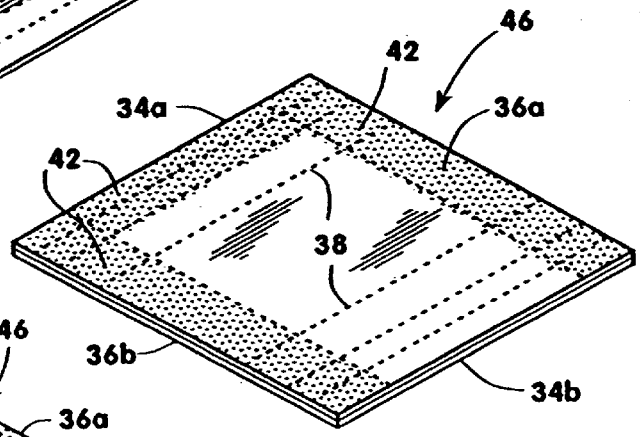

The assembly of porous member 46 is depicted in FIGS. 14–19. In FIG. 14, two separate pieces of filter paper 44 are superimposed upon each other and, in FIG. 15, are shown bonded along edges 34*a*, 36*a* and 36*b*, again preferably by heat, to form a pouch having an open side 34*b*.

Figure 16:
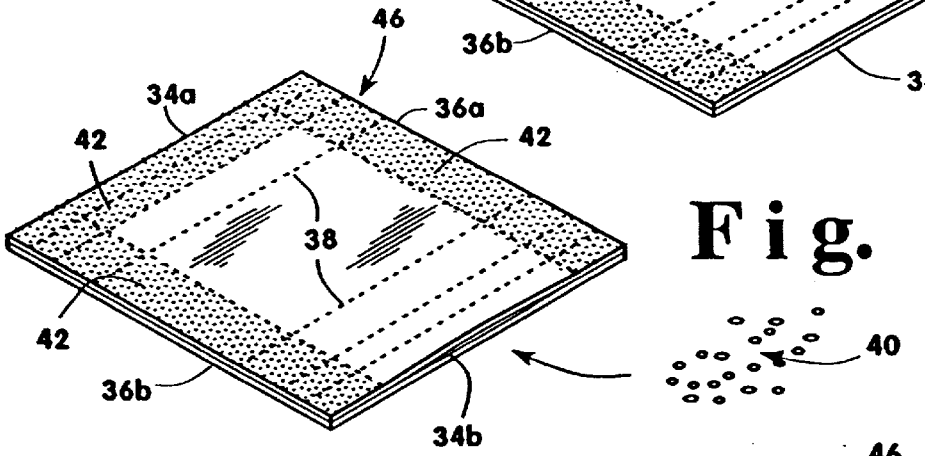
Figure 17:
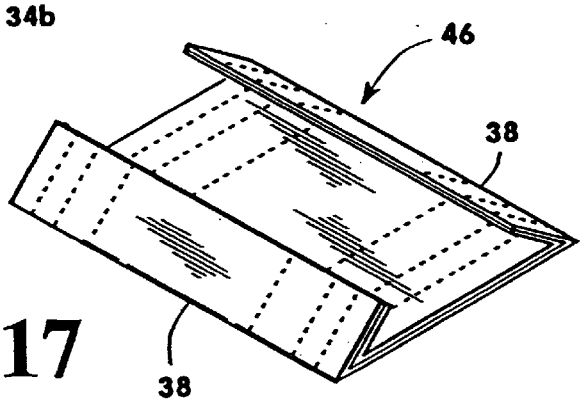
Figure 18:
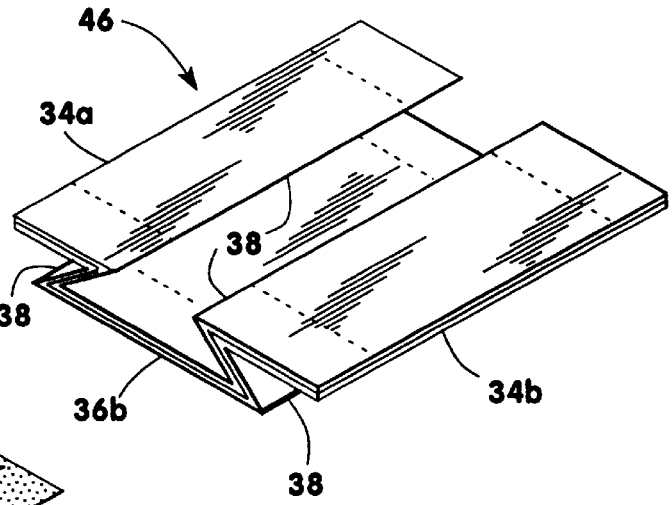
Figure 19:
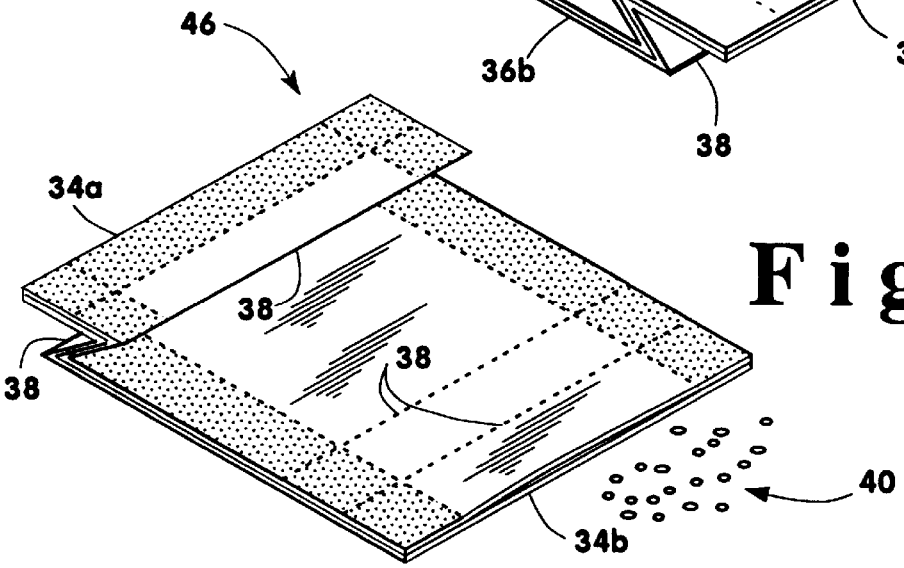
Figure 20:
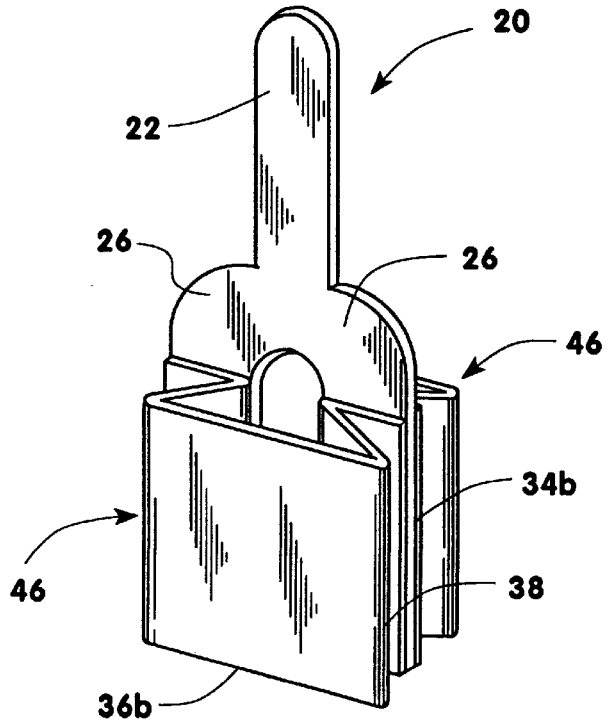

In FIG. 16, coffee 40 or other powdered infusible beverage substance is inserted through open edge 34*b* into porous member 46. After sealing edge 34*b*, porous member 46 is folded along a first set of vertical fold lines 38, as shown in FIG. 17. As shown in FIG. 18, a second fold along vertical fold lines 38 is made so that edges 34*a* and 34*b* now conform approximately to the width of support member 24. More preferably, as shown in FIG. 19, the empty porous member 46 is initially folded along the two sets of vertical fold lines 38 at the end near edge 34*a*, the powdered infusible beverage substance is inserted through open edge 34*b*, and then edge 34*b* is sealed and folded along the vertical fold lines in the manner of edge 34*a*. As shown in FIG. 20, regardless of the manner in which it is folded and filled with the powdered infusible beverage substance, porous member 46 is then attached to support device 20 by preferably heat bonding edges 34*a* and 34*b* respectively to the spaced apart legs 26 of device 20. More preferably, a second porous member 46, made in the same manner as previously described, is attached to the opposite side of legs 26 so that a pair of separate porous pouches are now supported by device 20. As before, porous member 46 is supported in its dry stored position with the porous member in a folded position. Again, upon immersion into a liquid, porous member 46 unfolds and expands to provide spacing therebetween and facilitate the infusion of the beverage preparation therein into the liquid.

Thus, the present invention provides the advantages of being easy and inexpensive to manufacture, particularly for mass production. Additionally, it is easy to use and provides for proper infusion of the infusible beverage preparation into the liquid. In the embodiments described which utilize a plurality of spaced pouches, there is provided increased contact area of the liquid, such as hot water, and the infusible beverage preparation in particle form, such as coffee, to facilitate greater flow of the liquid through the beverage preparation.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

What is claimed is:

1. A beverage infusion device comprising:

a handle;

a support member extending from said handle having a pair of support legs spaced apart by a predetermined width, said handle being of a configuration to fit between a pair of said support legs of a preceding or subsequent beverage infusion device support member such that said handle and said support legs of a preceding or subsequent beverage infusion device support member is stamped from a single piece of stock; and a flexible porous member having a pair of ends and an unfolded width greater than said predetermined width, each of said ends being attached to a respective support leg, said porous member containing an infusible beverage preparation, said porous member being supported by said support legs in a folded position wherein, upon immersion of said porous member in a liquid, said porous member expands to facilitate infusion of a beverage preparation therein into said liquid.

2. The device of claim 1 including a plurality of flexible porous members supported by said support legs.

3. The device of claim 1 wherein said support legs are flat and have opposite sides, and wherein said support legs supports a said porous member on each of said opposite sides.

4. The device of claim 1 wherein, in the folded position, said porous member has a plurality of folds across its width.

5. The device of claim 1 wherein, in the folded position, said porous member has folds adjacent the first and second ends and an unfolded portion therebetween.

6. The device of claim 1 wherein the porous member is heat bonded to said support legs.

7. The device of claim 1 wherein the porous member comprises a pouch of filter material, the infusible beverage preparation being adapted to be received within said pouch.

8. The device of claim 1 wherein said handle is integral with said support member and stamped from the same piece of stock.

9. The device of claim 1 wherein said handle and support member are made of flat stock selected from the group consisting of paper- or plastic-based materials.

10. A beverage infusion device comprising:

a support member having a pair of support legs spaced apart by a predetermined width;

a flexible porous member having a pair of ends, with each of said ends attached to a respective support leg, said porous member containing an infusible beverage preparation; and a handle extending from said support member, said handle being of a configuration to fit between a pair of said support legs of a preceding or subsequent beverage infusion device support member such that said handle and said support legs of a preceding or subsequent beverage infusion device support member is stamped from a single piece of stock.

11. The device of claim 10 wherein said handle is integral with said support member and stamped from the same piece of stock.

12. The device of claim 10 wherein said handle and support member are made of flat stock selected from the group consisting of paper- or plastic-based materials.

13. A method of making a beverage infusion device comprising:

providing flat stock of a material which is food safe and stable in hot water;

stamping from said flat stock a plurality of beverage infusion device support members, each of said support members having at one end a pair of support legs spaced apart by a predetermined width and at an opposite end a handle, said handle being of a configuration to fit between a pair of said support legs of a preceding or subsequent beverage infusion device support member, such that a handle of one support member is stamped from a region of said flat stock between legs of a preceding or subsequent support member; and attaching to the support legs of said support members a flexible porous member, said porous member containing an infusible beverage preparation.

14. The method of claim 13 wherein in each of said support members, said handle is integral with said legs and is stamped from the same piece of stock.

15. The method of claim 14 wherein said support members are stamped from flat stock selected from the group consisting of paper- or plastic-based materials.

16. The method of claim 13 further including inserting an infusible beverage preparation into said flexible porous member.

* * * * *

UNITED STATES PATENT AND TRADEMARK OFFICE

CERTIFICATE OF CORRECTION

PATENT NO. : 6,274,180 B1
DATED : August 14, 2001
INVENTOR(S) : Ryan et al.

It is certified that error appears in the above-identified patent and that said Letters Patent is hereby corrected as shown below:

Column 5,
Line 20, after "legs 26.", insert therefore -- Flexible porous member 32 has a pair of ends, with one end being attached to each of support legs 26. -

Signed and Sealed this

Twelfth Day of March, 2002

*Attest:*

*Attesting Officer*

JAMES E. ROGAN
*Director of the United States Patent and Trademark Office*